US010012385B2

(12) United States Patent
Hayek et al.

(10) Patent No.: US 10,012,385 B2
(45) Date of Patent: Jul. 3, 2018

(54) COMBUSTOR HEAT SHIELD SEALING

(71) Applicant: Pratt & Whitney Canada Corp., Longueuil (CA)

(72) Inventors: Daniel Hayek, Toronto (CA); Jason Herborth, Acton (CA); Yen-Wen Wang, Mississauga (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 564 days.

(21) Appl. No.: 14/455,185

(22) Filed: Aug. 8, 2014

(65) Prior Publication Data

US 2016/0040878 A1 Feb. 11, 2016

(51) Int. Cl.
*F23R 3/60* (2006.01)
*F23R 3/00* (2006.01)

(52) U.S. Cl.
CPC ..... *F23R 3/002* (2013.01); *F23R 3/60* (2013.01); *F23R 2900/00012* (2013.01)

(58) Field of Classification Search
CPC .. F23R 3/002; F23R 3/007; F23R 3/60; F23R 2900/00012; F23R 2900/03044; F23R 2900/00017; F23R 2900/00018; F23R 2900/00019; F01D 9/023; F01D 11/005; F02C 7/28; F02C 7/20; F05D 2240/55; F05D 2240/90; F05D 2240/91
See application file for complete search history.

(56) References Cited

U.S. PATENT DOCUMENTS 3,339,953 A * 9/1967 Bohn ..... E06B 3/26341 403/387
3,793,827 A 2/1974 Ekstedt
4,302,941 A * 12/1981 DuBell ..... F23R 3/08 60/755
4,944,151 A 1/1990 Hovnanian
5,337,583 A * 8/1994 Giles ..... F01D 9/023 24/573.09
5,758,503 A * 6/1998 DuBell ..... F23R 3/002 60/752
5,782,294 A * 7/1998 Froemming ..... F01D 5/288 165/168
6,408,628 B1 * 6/2002 Pidcock ..... F23R 3/002 60/752
6,470,685 B2 * 10/2002 Pidcock ..... F23R 3/08 60/752
6,901,757 B2 * 6/2005 Gerendas ..... F23M 5/00 110/336
6,997,814 B2 * 2/2006 Curley, Jr. ..... F16B 37/145 470/18

(Continued)

*Primary Examiner* — William H Rodriguez
*Assistant Examiner* — Jason H Duger
(74) *Attorney, Agent, or Firm* — Norton Rose Fulbright Canada

(57) ABSTRACT

A method and an apparatus for reducing airflow leakage between a combustor liner and a rail of a heat shield mounted to an inner surface of the combustor liner. The method comprises locally deforming the combustor liner in sealing engagement with the rail by applying a pressure on the outer surface of the combustor liner over the rail of the heat shield. A tool, such as a sealing clip, may be mounted in pressing engagement with the outer surface of the combustor liner to apply forces locally on the liner over the rail of the heat shield.

6 Claims, 4 Drawing Sheets

(56) References Cited

U.S. PATENT DOCUMENTS

| | | | | |
|---|---|---|---|---|
| 7,093,439 | B2 * | 8/2006 | Pacheco-Tougas | F23R 3/002 60/752 |
| 7,093,441 | B2 * | 8/2006 | Burd | F23R 3/42 60/752 |
| 7,140,185 | B2 * | 11/2006 | Burd | F23M 5/085 110/336 |
| 7,674,080 | B2 * | 3/2010 | Agg | F16B 39/101 411/121 |
| 7,849,694 | B2 * | 12/2010 | Dahlke | F23M 5/02 60/752 |
| 2002/0056277 | A1 * | 5/2002 | Parry | F23M 5/04 60/752 |
| 2005/0034399 | A1 * | 2/2005 | Pidcock | F23R 3/002 52/506.1 |
| 2014/0130501 | A1 * | 5/2014 | Clemen | F23R 3/00 60/722 |

* cited by examiner

COMBUSTOR HEAT SHIELD SEALING

TECHNICAL FIELD

The application relates generally to gas turbine engines and, more particularly, to combustor heat shield sealing.

BACKGROUND OF THE ART

Heat shields such as those used to protect the combustor liners, are exposed to hot gases in the primary combustion zone. The amount of coolant available for cooling the heat shields must be minimized to improve the combustion efficiency and to reduce smoke, unburned hydrocarbon and CO/NOx emission.

It is thus suitable to reduce coolant leakage between the combustor heat shields and the combustor shell.

SUMMARY

In one aspect, there is provided a method of providing a seal between a combustor liner and a rail of a heat shield mounted to an inner surface of the combustor liner, the method comprising: locally deforming the combustor liner in sealing engagement with the rail by applying a pressure on the outer surface of the combustor liner over the rail of the heat shield.

In another aspect, there is provided a sealing clip for a combustor of a gas turbine engine, the combustor having a combustor liner and a heat shield mounted to an inner surface of the combustor liner with a back surface of the heat shield in spaced-apart facing relationship with the inner surface of the combustor liner, the heat shield having a sealing rail extending from the back side thereof; the sealing clip comprising: an elongated body configured to embrace an outer surface of the combustor liner in an overlying relationship to the sealing rail of the heat shield, the elongated body extending between opposed anchoring points configured for engagement with bolts on the outer surface of the combustor liner.

In a further aspect, there is provided a combustor of a gas turbine engine, the combustor comprising: a combustor liner defining a combustion chamber, a heat shield mounted to an inner surface of the combustor liner in the combustion chamber, the heat shield having a rail projecting from a back face thereof, a sealing clip mounted in pressing engagement to an outer surface of the combustor liner over the rail of the heat shield, the sealing clip locally deforming the combustor liner in sealing engagement against the rail of the heat shield.

DESCRIPTION OF THE DRAWINGS

Reference is now made to the accompanying figures in which.

DETAILED DESCRIPTION

Figure 1:
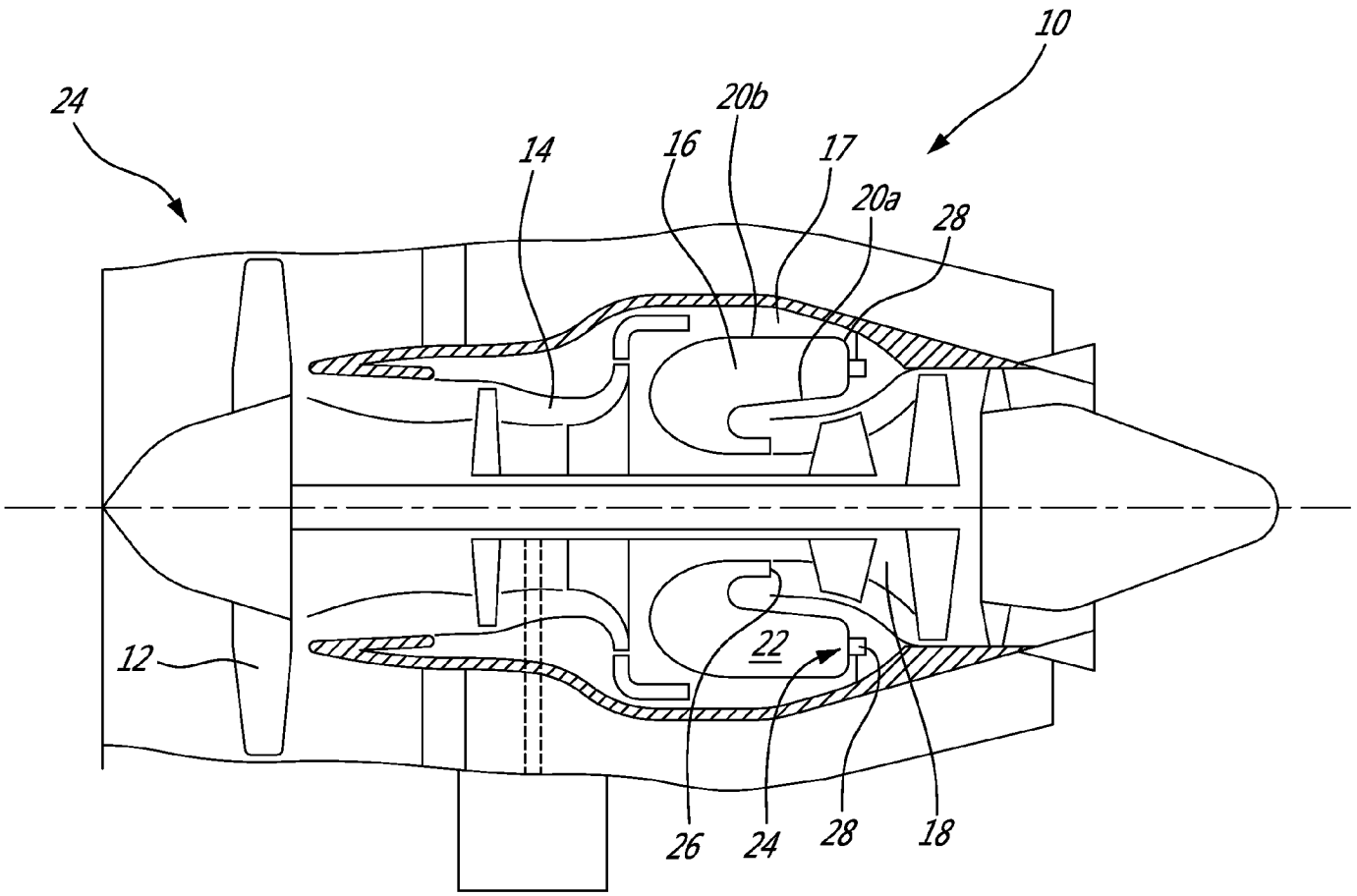
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

The combustor 16 is housed in a plenum 17 supplied with compressed air from compressor 14. As shown in FIG. 1, the combustor 16 may comprise a reverse flow annular combustor shell including a radially inner liner 20*a* and a radially outer liner 20*b*, defining a combustion chamber 22. The combustor 16 has a bulkhead or inlet dome portion 24. The combustor 16 further has an exit portion 26 for communicating combustion gases with the turbine section 18. Fuel nozzles 28 extend through the dome portion 24 of the combustor 16 to deliver a fuel-air mixture to the combustion chamber 22.

Figure 2:
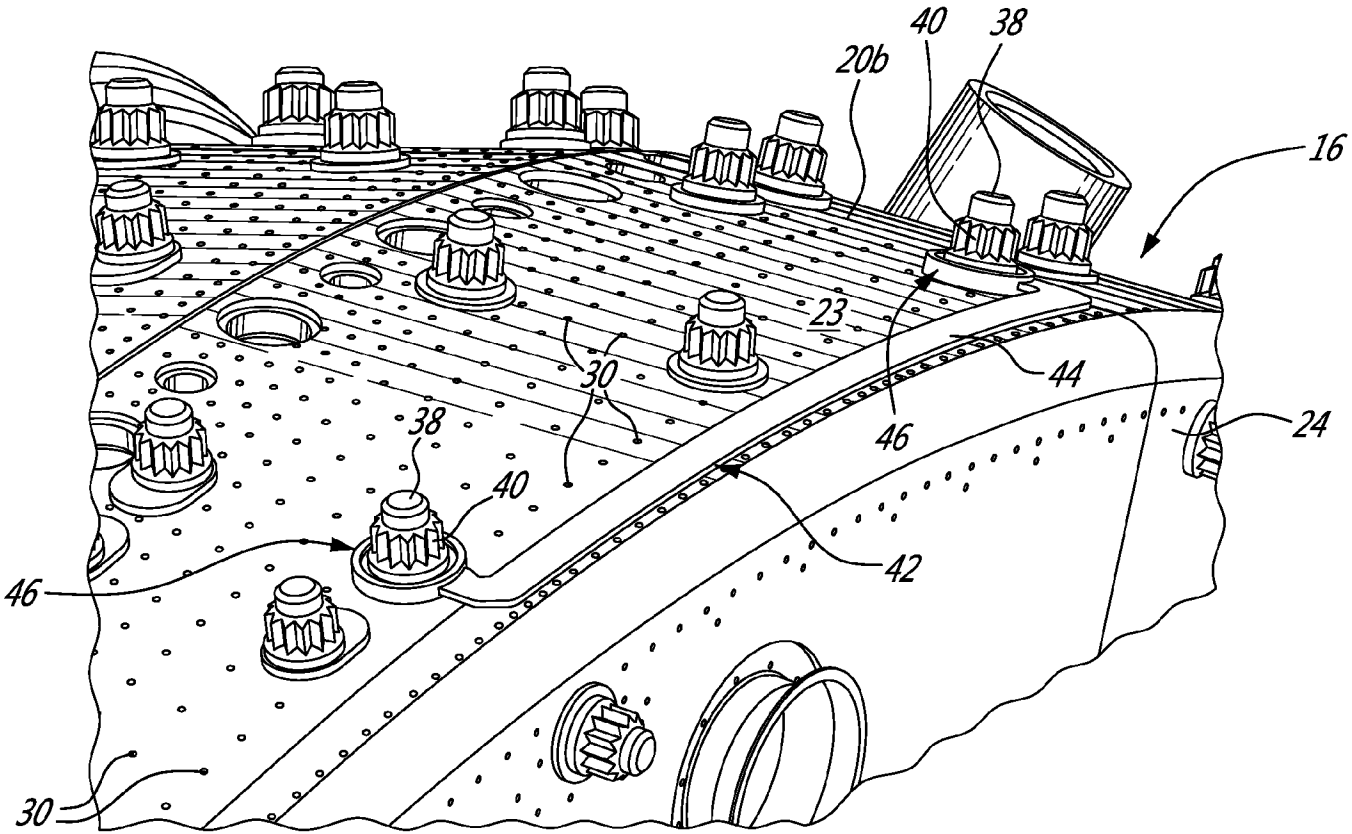
FIG. 2 is an enlarged isometric view of a portion of a combustor of the gas turbine engine and illustrating a sealing clip bolted down on the combustor liner to locally deform the liner in sealing engagement with an underlying sealing rail projecting from the back surface of a heat shield mounted to the inner surface of the combustor liner.

As shown in FIG. 2, a plurality of impingement holes 30 may be defined in the combustor liners for cooling purposes. Dilution holes may also be provided for combustion purposes. The liners 20*a*, 20*b* may have any suitable configuration. The liners are typically made out of sheet metal, though any suitable material(s) and manufacturing method (s) may be used.

Figure 3:
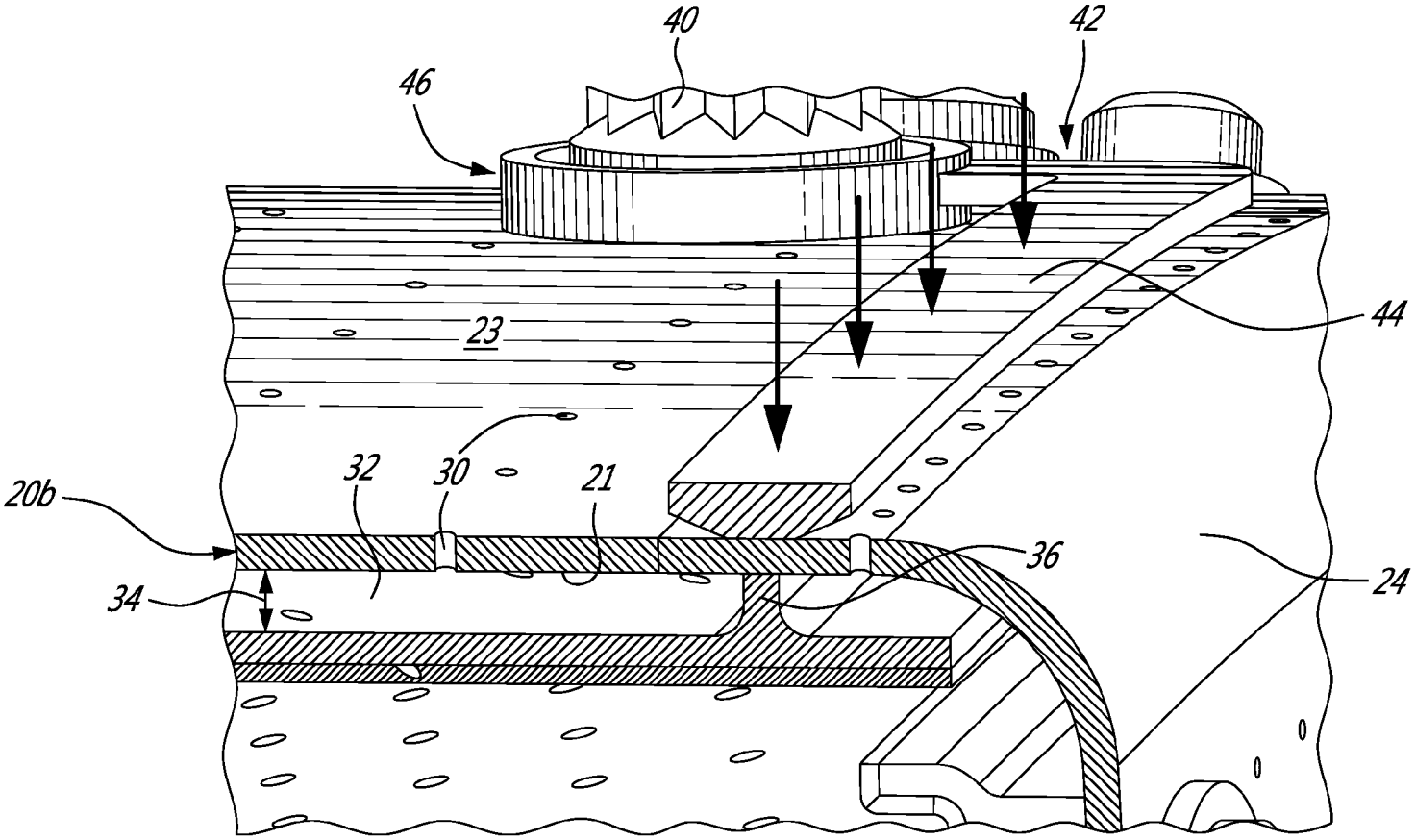
FIG. 3 is a fragmentary isometric view of a section of the combustor illustrating local forces transferred from the clip to the liner in order to reduce any existing leakage gap between the rail of the heat shield and the combustor liner.

As can be appreciated from FIG. 3, the inner surface 21 of the combustor liners 20*a*, 20*b* is lined with heat shields 32 of ceramic for example that protect the combustor liners from direct exposure to hot combustion gases. The heat shields 32 may be bolted to the liners 20*a*, 20*b*. Each heat shield 32 may be provided on the back surface thereof with a number of studs 38 extending through corresponding mounting holes defined in the combustor liners 20*a*, 20*b*. Nuts 40 are threadably engaged on a threaded end portion of each stud 38 outwardly of the combustor 16 to securely hold the heat shields 32 in position on the inner surface 21 of the liners 20*a*, 20*b*.

Compressed air passes through the impingement holes 30 in the combustor liners 20*a*, 20*b* into an intermediate cooling cavity 34 between the liners 20*a*, 20*b* and the combustor heat shields 32. The air passes through the cooling cavity 34 and is admitted into the combustion chamber 22 through perforations in the heat shields 32, thereby creating a cooling air curtain along the hot inner surfaces of the heat shields 32.

Figure 4:
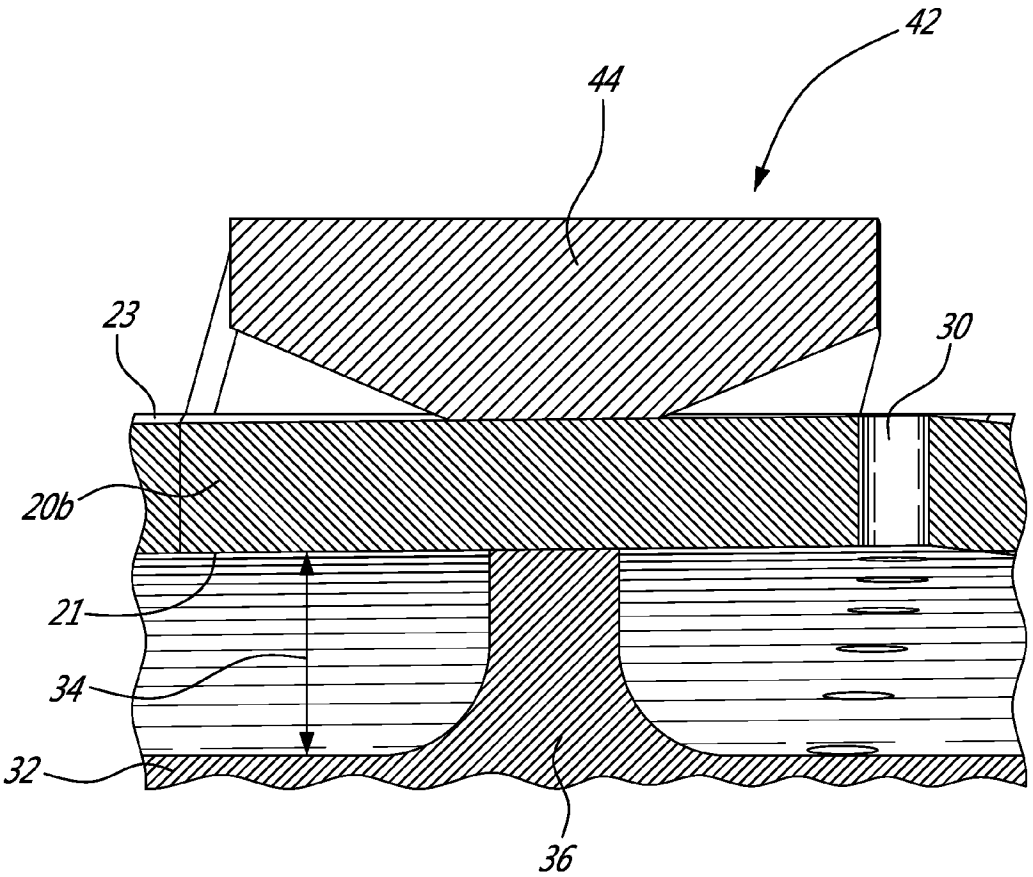
FIG. 4 is a cross-section view of the combustor liner with the sealing clip locally pressing the combustor liner in sealing engagement with the sealing rail of the combustor heat shield.

As shown in FIGS. 3 and 4, rails 36 extend from the back face of the heat shields 32 to compartmentalize the cooling cavity 34 and direct the flow of cooling air. The rails 36 conform closely to the inner surface 21 of the combustor liners 20*a*, 20*b*. However, due to manufacturing tolerances a leakage gap remains between the rails 36 and the liners 20*a*, 20*b*. In other words, the rails 36 sealed against the combustor liners with a gap (e.g. 0.002"-0.004") between. Air leakage occurs through this gap since compressed cooling air is contained within the cooling cavity 34 under a higher pressure than the combustion gases within the combustion chamber 22. Compressed air is intended to pass from the plenum 17 through the perforated liners 20*a*, 20*b* into the cooling cavity 34, then into the combustion chamber 22 through the perforated heat shields 32. However leakage through the gap between the rails 36 and the inner surface 21 of the liners 20*a*, 20*b* is uncontrolled and undesirable which can decrease engine efficiency through increased use of compressed cooling air and unintended dilution of combustion gases. Leakage is especially undesirable in smaller engines since manufacturing tolerances are similar to those of larger engines; however the proportion of leakage relative to controlled air flow is greater in smaller engines. The same size of gap will lead to a generally greater proportion of leaked air relative to controlled air in a smaller engine compared to a larger engine. For some small engine combustors, much of cooling flow may be wasted and leaked through those gaps. The cooling flow could be better utilized with reduction in leakage flow.

Airflow leakage between the combustor liners 20*a*, 20*b* and the rails 36 of the combustor heat shields 32 may be reduced by applying force locally on the liners at the appropriate location. As will be seen hereinafter, this may even be done without blocking any impingement holes 30 using existing fastening structures. As shown in FIGS. 2 and 3, airflow leakage may be reduced by bolting down a sealing clip 42 on the outer surface 23 of the liners 20*a*, 20*b* directly over an associated one of the rails 36. The sealing clip 42 has an elongated body 44 extending between two opposed anchoring points 46. The elongated body 44 is configured to follow the profile of the combustor liners. The length of the elongated body 44 is selected so as to generally correspond to that of the underlying rail 36. Each anchoring point 46 comprises a washer like portion defining a central hole for receiving a corresponding one of the studs 38 extending from the back face of the heat shields 32. This allows controlling the liner deformation using existing studs. It can be appreciated from, FIG. 2, that the anchoring points 46 are axially offset with respect to the elongated body 44. The relative position of the elongated body 44 and the anchoring points 46 is set by the location of the studs 38 and the rails 36 on the heat shields 32. However, it is understood that non-existing threaded connections could be used as well to bolt the sealing clip 42 onto the liner. According to this embodiment, the relative disposition of the anchoring points and the elongated body would no longer be function of the relative location of the heat shield studs and rails.

As schematically depicted in FIG. 3, the local force can be applied on the liner over the rail 36 by tightening the nuts 40 on the threaded studs 38. The torque on the nuts 40 is transferred to the elongated body 44 of the sealing clip 42 which in turn uniformly distribute the pressure on the liner along the underlying rail 36 of the heat shield 32. The geometry of the sealing clip 42 controls the liner deformation locally and reduces the leakage gap between the rail of the combustor heat shield and the liner.

According to the illustrated embodiment the elongated body 44 is provided in the form of a low profile metal bar having a trapezoidal tapering section. However, it is understood that the elongated body 44 could adopt various configurations.

It is also understood that other apparatus could be used to locally deform the combustor liner in sealing engagement with a heat shield rail by applying a pressure locally on the outer surface of the combustor liner. The present method of reducing airflow leakage is thus not limited to the use of the sealing clip shown in FIGS. 2-4. Indeed other tools may be used for applying local forces on the outer surface of the combustor liner along the length of the rail of the heat shield. According to some application, the tool used for applying local forces on the outer surface of the liner may be removed once the liner has been locally deformed in sealing engagement with the underlying rail of the heat shield. According to other applications, the tool, such as sealing clip 42, may be left on the combustor liner during engine operation.

From the foregoing, it can be appreciated that the above described embodiments may be used to reduce the flow leakage between the combustor heat shields and liner without tightening existing sheet metal/casting profile tolerances, which increases cost.

The above description is meant to be exemplary only, and one skilled in the art will recognize that changes may be made to the embodiments described without departing from the scope of the invention disclosed. For example, it is understood that the principles of the present invention could be applied to various types of combustor and heat shields. Still other modifications which fall within the scope of the present invention will be apparent to those skilled in the art, in light of a review of this disclosure, and such modifications are intended to fall within the appended claims.

The invention claimed is:

1. A combustor of a gas turbine engine, the combustor comprising: a combustor liner defining a combustion chamber, a heat shield mounted to an inner surface of the combustor liner in the combustion chamber, the heat shield having a rail projecting from a back face of the heat shield, a sealing clip mounted to an outer surface of the combustor liner, the sealing clip having two anchoring points and an elongated body, the elongated body aligned with and positioned over the rail of the heat shield along a length and extending between the two anchoring points, the two anchoring points axially offset and spaced from the elongated body and the rail, each of the two anchoring points defining a respective hole in the sealing clip to facilitate mounting and holding of the elongated body in pressing engagement with the outer surface of the combustor liner, the elongated body redistributing a bolting pressure applied at the two anchoring points, and wherein the elongated body locally deforms the combustor liner in sealing engagement against the rail of the heat shield along the length.

2. The combustor defined in claim 1, the respective holes in the sealing clip of the two anchoring points receiving respective studs projecting outwardly through respective mounting holes defined in the combustor liner, the respective studs each having a threaded portion for threaded engagement with a respective nut.

3. The combustor defined in claim 2, wherein the respective studs extend from the back face of the heat shield through the respective mounting holes defined in the combustor liner.

4. The combustor defined in claim 2, wherein the length the elongated body is aligned with and positioned over the rail of the heat shield generally corresponds to a length of the rail of the heat shield.

5. The combustor defined in claim 2, the elongated body being pressed against the outer surface of the combustor liner by the respective nuts engaging the respective threaded portions of the respective studs.

6. The combustor defined in claim 2, wherein each of the two anchoring points comprises a washer portion.

* * * * *